US010145370B2

(12) United States Patent
Ogawa et al.

(10) Patent No.: US 10,145,370 B2
(45) Date of Patent: Dec. 4, 2018

(54) DOUBLE-HEADED PISTON TYPE SWASH PLATE COMPRESSOR

(71) Applicant: KABUSHIKI KAISHA TOYOTA JIDOSHOKKI, Aichi-ken (JP)

(72) Inventors: Hiromichi Ogawa, Kariya (JP); Shinya Yamamoto, Kariya (JP); Hiroyuki Nakaima, Kariya (JP); Takahiro Suzuki, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 150 days.

(21) Appl. No.: 15/442,166

(22) Filed: Feb. 24, 2017

(65) Prior Publication Data

US 2017/0284383 A1 Oct. 5, 2017

(30) Foreign Application Priority Data

Mar. 30, 2016 (JP) ..... 2016-068654

(51) Int. Cl.
*F04B 53/14* (2006.01)
*F04B 27/08* (2006.01)
(Continued)

(52) U.S. Cl.
CPC ..... *F04B 27/0886* (2013.01); *F04B 27/005* (2013.01); *F04B 27/0878* (2013.01);
(Continued)

(58) Field of Classification Search
CPC ..... F04B 27/1054; F04B 27/1804; F04B 2027/1809; F04B 2027/1822; F04B 2027/184
See application file for complete search history.

(56) References Cited

U.S. PATENT DOCUMENTS 5,528,976 A 6/1996 Ikeda et al.
6,324,960 B1 12/2001 Enokijima et al.
(Continued)

FOREIGN PATENT DOCUMENTS

CN 101598121 12/2009
EP 1 039 128 9/2000
(Continued)

OTHER PUBLICATIONS

Chinese Office Action issued in Chinese Patent Appl. No. 201710099670.7, dated Jul. 4, 2018.
(Continued)

*Primary Examiner* — Patrick Hamo
(74) *Attorney, Agent, or Firm* — Greenblum & Bernstein, P.L.C.

(57) ABSTRACT

A double-headed piston type swash plate compressor includes a rotation shaft, a housing, a swash plate, two cylinder bores, a double-headed piston, and two shoes. The double-headed piston includes two shoe holders, a neck, two heads, and two coupling portions. Each of the coupling portions includes an outer portion and an inner portion. A direction orthogonal to both of an opposing direction of the inner portion and the outer portion and the axial direction of the double-headed piston is referred to as a widthwise direction. The inner portion includes a narrow portion and a wide portion. The wide portion projects out of the narrow portion in the widthwise direction and has a larger width than the narrow portion. An outer surface of the wide portion is slidable on a wall surface of the corresponding cylinder bore when the double-headed piston reciprocates in the cylinder bores.

4 Claims, 6 Drawing Sheets

(51) Int. Cl.

| | |
|---|---|
| ***F04B 27/00*** | (2006.01) |
| ***F04B 27/10*** | (2006.01) |
| ***F04B 27/18*** | (2006.01) |
| ***F04B 39/00*** | (2006.01) |

(52) U.S. Cl.
CPC ..... *F04B 27/1036* (2013.01); *F04B 27/1045* (2013.01); *F04B 27/1054* (2013.01); *F04B 27/18* (2013.01); *F04B 39/0005* (2013.01); *F04B 53/14* (2013.01)

(56) References Cited

U.S. PATENT DOCUMENTS

| | | | | |
|---|---|---|---|---|
| 6,332,394 | B1 | 12/2001 | Kato et al. | |
| 6,398,516 | B1 * | 6/2002 | Kawaguchi | F04B 27/1804 417/222.2 |
| 6,453,554 | B1 | 9/2002 | Fukushima et al. | |
| 9,429,147 | B2 | 8/2016 | Suzuki et al. | |
| 2003/0202885 | A1 * | 10/2003 | Taguchi | F04B 27/1804 417/213 |
| 2003/0210989 | A1 * | 11/2003 | Matsuoka | F04B 27/1036 417/222.2 |
| 2013/0189121 | A1 * | 7/2013 | Ota | F04B 1/29 417/53 |
| 2015/0167655 | A1 | 6/2015 | Yamamoto et al. | |

FOREIGN PATENT DOCUMENTS

| | | |
|---|---|---|
| JP | 7-189900 | 7/1995 |
| JP | 7-197883 | 8/1995 |
| JP | 2807068 | 9/1998 |
| JP | 2000-274350 | 10/2000 |
| JP | 2001-012344 | 1/2001 |
| JP | 2001-065452 | 3/2001 |
| JP | 2012-112325 | 6/2012 |
| JP | 2015-161173 | 9/2015 |
| KR | 1020150070023 | 6/2015 |

OTHER PUBLICATIONS

Korean Office Action issued in counterpart Patent Appl. No. KR10-2017-0022320, dated Feb. 12, 2018.
U.S. Appl. No. 15/442,064 to Hiromichi Ogawa et al., filed Feb. 24, 2017.
U.S. Appl. No. 15/442,268 to Hiromichi Ogawa et al., filed Feb. 24, 2017.

* cited by examiner

DOUBLE-HEADED PISTON TYPE SWASH PLATE COMPRESSOR

BACKGROUND OF THE INVENTION

The present invention relates to a double-headed piston type swash plate compressor.

One example of a compressor is a double-headed piston type swash plate compressor including a swash plate that rotates when a rotation shaft rotates and a double-headed piston that reciprocates in a pair of cylinder bores when the swash plate rotates. The double-headed piston compresses refrigerant in compression chambers that are defined in the two cylinder bores when the double-headed piston reciprocates (refer to Japanese Laid-Open Patent Publication No. 7-197883).

When the double-headed piston reciprocates in the cylinder bores, the heads of the double-headed piston slide on the wall surfaces of the cylinder bores. Refrigerant contains lubricant that lubricates the sliding components. When the lubricant between the heads and the wall surfaces of the cylinder bores becomes insufficient, friction easily occurs between the heads and the wall surfaces of the cylinder bores. This reduces the durability.

SUMMARY OF THE INVENTION

It is an object of the present invention to provide a double-headed piston type swash plate compressor that improves lubrication between the heads of a double-headed piston and the wall surfaces of the cylinder bores.

To achieve the above object, a double-headed piston type swash plate compressor according to one aspect of the present invention includes a rotation shaft, a housing, a swash plate, two cylinder bores, a double-headed piston, and two shoes. The rotation shaft extends in an axial direction and a radial direction. The housing accommodates the rotation shaft. The swash plate rotates when the rotation shaft rotates. The two cylinder bores are opposed to each other in the axial direction of the rotation shaft and located in the housing at an outer side of the rotation shaft in the radial direction. The double-headed piston reciprocates in the two cylinder bores. The two shoes couple the double-headed piston to the swash plate. The two cylinder bores and the double-headed piston define two compression chambers. Rotation of the swash plate reciprocates the double-headed piston in the two cylinder bores and compresses refrigerant in each of the compression chambers. The double-headed piston includes two shoe holders, a neck, two heads, and two coupling portions. The two shoe holders hold the two shoes. The two shoe holders are opposed to each other in an axial direction of the double-headed piston. The neck couples the two shoe holders. The neck is located at an outer circumferential side of the swash plate. The two heads are located at two ends of the double-headed piston in the axial direction of the double-headed piston. The two heads are respectively located in the two cylinder bores. The two coupling portions couple the two shoe holders and the two heads, respectively. Each of the coupling portions includes an outer portion and an inner portion. The outer portion extends in the axial direction of the double-headed piston. The inner portion is located at an inner side of the outer portion in the radial direction. The inner portion is extended in the axial direction of the double-headed piston and opposed to the outer portion in the radial direction. A direction orthogonal to both of an opposing direction of the inner portion and the outer portion and the axial direction of the double-headed piston is referred to as a widthwise direction. The inner portion includes a narrow portion extending continuously from the corresponding head and a wide portion located at a side opposite to the head with respect to the narrow portion in the axial direction of the double-headed piston. The wide portion projects out of the narrow portion in the widthwise direction and has a larger width than the narrow portion. An outer surface of the wide portion is slidable on a wall surface of the corresponding cylinder bore when the double-headed piston reciprocates in the cylinder bores.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of a double-headed piston type swash plate compressor will now be described with reference to FIGS. 1 to 6. The double-headed piston type swash plate compressor of the present embodiment is installed in a vehicle for use with a vehicle air conditioner.

Figure 1:
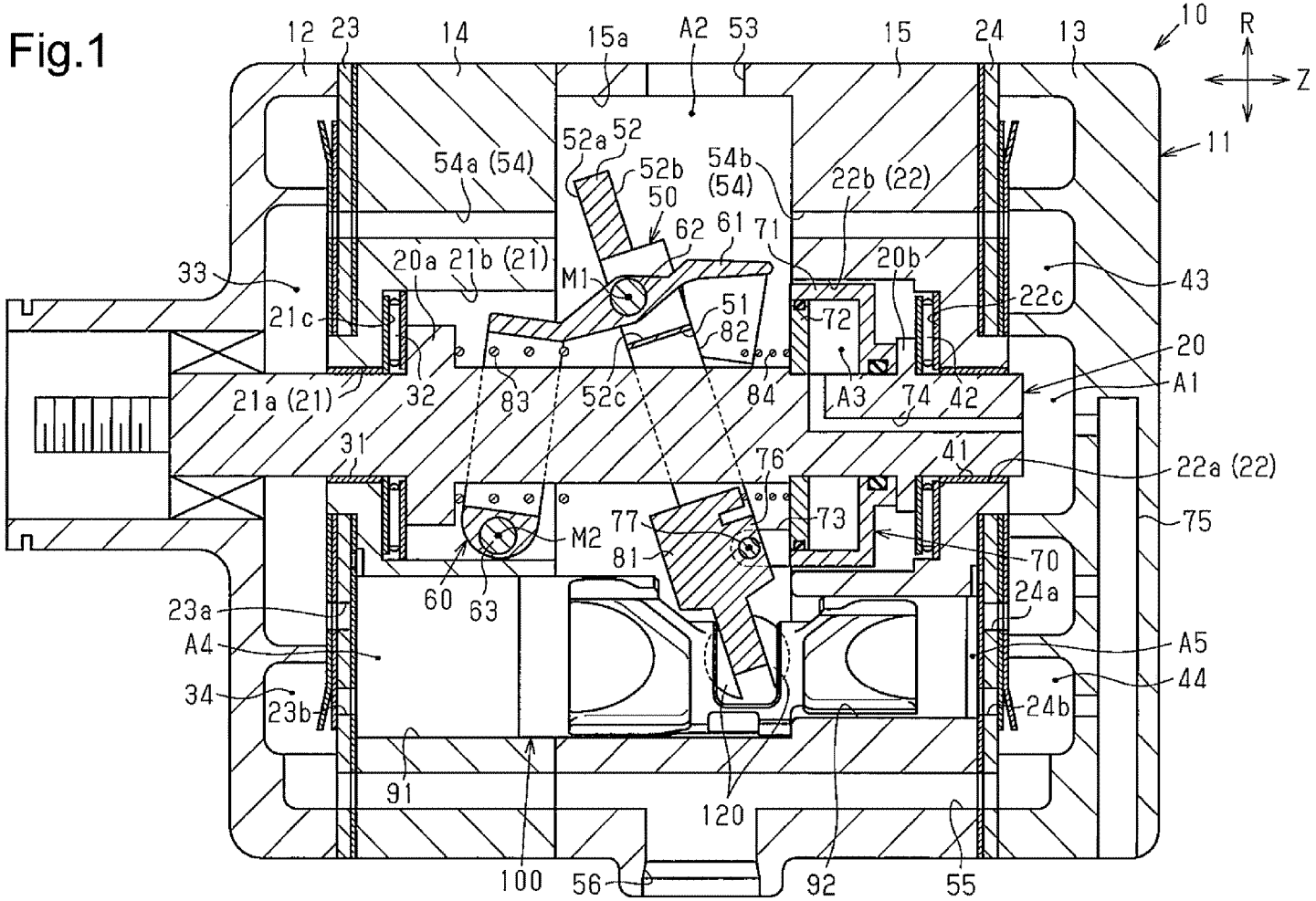
FIG. 1 is a cross-sectional view schematically showing a double-headed piston type swash plate compressor.

As shown in FIG. 1, a double-headed piston type swash plate compressor 10 (hereinafter referred to as compressor 10) includes a housing 11 that forms the shell of the compressor 10. The entire housing 11 is tubular.

A rotation shaft 20 is accommodated in the housing 11 in a rotatable manner. The rotation shaft 20 is located near the center in the housing 11. The axial direction Z of the rotation shaft 20 corresponds to the axial direction of the housing 11. In the following description, the axial direction Z of the rotation shaft 20 is referred to as the axial direction Z.

The housing 11 includes a tubular front housing 12, which forms one end of the housing 11 in the axial direction Z, a tubular rear housing 13, which has a bottom and forms the other end of the housing 11 in the axial direction Z, and two cylinder blocks 14 and 15 (first cylinder block 14 and second cylinder block 15), which are arranged between the front housing 12 and the rear housing 13. The cylinder blocks 14 and 15 are cylindrical and respectively include first and second shaft holes 21 and 22 through which the rotation shaft 20 can be inserted.

The first cylinder block 14 includes the first shaft hole 21 that extends through the first cylinder block 14 in the axial direction Z. The first shaft hole 21 includes a first small diameter hole 21*a*, which has a slightly larger diameter than the rotation shaft 20, and a first large diameter hole 21*b*, which is larger than the first small diameter hole 21*a*. The first small diameter hole 21*a* is located closer to the front housing 12 than the first large diameter hole 21*b*.

The second cylinder block 15 includes the second shaft hole 22 that extends through the second cylinder block 15 in the axial direction Z. The second shaft hole 22 includes a second small diameter hole 22*a*, which has a slightly larger diameter than the rotation shaft 20, and a second large diameter hole 22*b*, which is larger than the second small diameter hole 22*a*. The second small diameter hole 22*a* is located closer to the rear housing 13 than the second large diameter hole 22*b*.

The two cylinder blocks 14 and 15 are coupled to each other with the two shaft holes 21 and 22 (more specifically, two large diameter holes 21*b* and 22*b*) opposing each other in the axial direction Z. The first cylinder block 14 is coupled to the front housing 12, and the second cylinder block 15 is coupled to the rear housing 13.

A first valve/port body 23 is arranged between the front housing 12 and the first cylinder block 14. A second valve/port body 24 is arranged between the rear housing 13 and the second cylinder block 15. The valve/port bodies 23 and 24 each have the form of a flat ring. The valve/port bodies 23 and 24 have a larger inner diameter than the rotation shaft 20.

The rotation shaft 20 is inserted through the two shaft holes 21 and 22 and the two valve/port bodies 23 and 24 and extended from the front housing 12 to the rear housing 13. In this case, one end of the rotation shaft 20 in the axial direction Z is located in the front housing 12, and the other end of the rotation shaft 20 in the axial direction Z is located in a regulation chamber A1, which is defined by the rear housing 13 and the second cylinder block 15. That is, the rotation shaft 20 extends through the two cylinder blocks 14 and 15 and the two valve/port bodies 23 and 24. The regulation chamber A1 is located in the central portion of the rear housing 13.

A first radial bearing 31 that rotationally supports the rotation shaft 20 is arranged between the rotation shaft 20 and a wall surface of the first small diameter hole 21*a*. In the same manner, a second radial bearing 41 that rotationally supports the rotation shaft 20 is arranged between the rotation shaft 20 and a wall surface of the second small diameter hole 22*a*. The rotation shaft 20 is supported by the two radial bearings 31 and 41 in the housing 11 in a rotatable manner.

The rotation shaft 20 includes a first shaft projection 20*a* and a second shaft projection 20*b*. The first shaft projection 20*a* is located in the first large diameter hole 21*b* and projected in the radial direction R of the rotation shaft 20 (hereinafter referred to as radial direction R), and the second shaft projection 20*b* is located in the second large diameter hole 22*b* and projected in the radial direction R. The first shaft projection 20*a* is extended in the radial direction R and opposed to a step surface 21*c* in the axial direction Z. The step surface 21*c* connects the first small diameter hole 21*a* to the first large diameter hole 21*b*. A first thrust bearing 32 is arranged between the first shaft projection 20*a* and the step surface 21*c*. The second shaft projection 20*b* is extended in the radial direction R and opposed to a step surface 22*c* in the axial direction Z. The step surface 22*c* connects the second small diameter hole 22*a* to the second large diameter hole 22*b*. A second thrust bearing 42 is arranged between the second shaft projection 20*b* and the step surface 22*c*.

The housing 11 includes two suction chambers 33 and 43 (first suction chamber 33 and second suction chamber 43) and two discharge chambers 34 and 44 (first discharge chamber 34 and second discharge chamber 44). Each of the first suction chamber 33 and the first discharge chamber 34 is defined by the front housing 12 and the first valve/port body 23. Each of the second suction chamber 43 and the second discharge chamber 44 is defined by the rear housing 13 and the second valve/port body 24. The two suction chambers 33 and 43 are opposed to each other in the axial direction Z, and the two discharge chambers 34 and 44 are opposed to each other in the axial direction Z. The suction chambers 33 and 43 and the discharge chambers 34 and 44 are formed to be annular as viewed in the axial direction Z, and the discharge chambers 34 and 44 are located at the outer sides of the suction chambers 33 and 43.

The compressor 10 includes a swash plate 50 that rotates when the rotation shaft 20 rotates. The swash plate 50 is inclined with respect to a direction that is orthogonal to the axial direction Z of the rotation shaft 20.

The swash plate 50 includes a swash plate body 52, which has the form of a flat ring. The swash plate body 52 includes a swash plate insertion hole 51 through which the rotation shaft 20 is inserted. The swash plate body 52 includes a first inclined surface 52*a*, which is directed toward the first cylinder block 14, and a second inclined surface 52*b*, which is directed toward the side opposite to the first inclined surface 52*a*.

The swash plate 50 of the present embodiment is configured so that the inclination angle can be changed with respect to the direction orthogonal to the axial direction Z of the rotation shaft 20.

The housing 11 includes a swash plate chamber A2 that accommodates the swash plate 50. The swash plate chamber A2 is defined by the two cylinder blocks 14 and 15. The swash plate chamber A2 is located between the two shaft holes 21 and 22 and is in communication with the two shaft holes 21 and 22.

A side wall of the second cylinder block 15 defining the swash plate chamber A2 includes a suction port 53. Thus, the suction port 53 is in communication with the swash plate chamber A2. Further, the housing 11 includes a suction passage 54 through which the swash plate chamber A2 is in communication with the suction chambers 33 and 43. The suction passage 54 includes a first suction passage 54*a* and a second suction passage 54*b*. The first suction passage 54*a* extends through the first cylinder block 14 and the first valve/port body 23 in the axial direction Z and allows communication between the swash plate chamber A2 and the first suction chamber 33. The second suction passage 54*b* extends through the second cylinder block 15 and the second valve/port body 24 in the axial direction Z and allows communication between the swash plate chamber A2 and the second suction chamber 43.

Refrigerant that is drawn from the suction port 53 flows through the swash plate chamber A2 and the suction passage 54 into the suction chambers 33 and 43. In this case, the swash plate chamber A2 and the two large diameter holes 21*b* and 22*b* that are in communication with the swash plate chamber A2 have the same pressure as the refrigerant drawn from the suction port 53. The refrigerant contains lubricant that lubricates sliding components.

The housing 11 includes a discharge passage 55 that is in communication with the two discharge chambers 34 and 44. The discharge passage 55 is located at the outer side of the swash plate chamber A2 and cylinder bores 91 and 92 (first and cylinder bores 91 and 92, described below) in the radial direction R. The discharge passage 55 is in communication with a discharge port 56, which is located in the housing 11 (more specifically, side wall of second cylinder block 15). Refrigerant in the two discharge chambers 34 and 44 is discharged out of the discharge port 56 through the discharge passage 55.

The compressor 10 includes a link mechanism 60 that allows the inclination angle of the swash plate 50 to change and links the swash plate 50 to the rotation shaft 20 so that the swash plate 50 and the rotation shaft 20 integrally rotate. The link mechanism 60 is located closer to the front housing 12 than the swash plate 50 except for part of the link mechanism 60.

The link mechanism 60 includes a lug arm 61, a first link pin 62, and a second link pin 63. The lug arm 61 extends from the first large diameter hole 21*b* to the swash plate chamber A2. The first link pin 62 pivotally couples the lug arm 61 to the swash plate 50. The second link pin 63 pivotally couples the lug arm 61 to the rotation shaft 20.

The lug arm 61 is L-shaped and includes a basal portion opposing the front housing 12 and a distal portion opposing the swash plate 50. The distal portion of the lug arm 61 projects out of the swash plate 50 toward the rear housing 13 through an arm through hole 52*c* in the swash plate body 52 of the swash plate 50. The projecting portion includes a weight.

The arm through hole 52*c*, for example, does not have an annular shape extending over the entire circumference of the swash plate 50 and is rectangular as viewed in the axial direction Z. The arm through hole 52*c* includes an inner surface including two opposing inner surfaces that are opposed to each other in the direction orthogonal to both the axial direction Z and the direction parallel to the axes of the swash plate insertion hole 51 and the arm through hole 52*c*.

The first link pin 62 is, for example, cylindrical. The first link pin 62 is located in the arm through hole 52*c* so that the axial direction of the first link pin 62 corresponds to the opposing direction of the two opposing inner surfaces. The first link pin 62 is extended through a portion of the lug arm 61 extending in the axial direction Z and attached to the swash plate 50. The portion of the lug arm 61 extending in the axial direction Z is supported by the swash plate 50 pivotally about the axis of the first link pin 62, which serves as the first pivot center M1.

The second link pin 63 is, for example, cylindrical. The second link pin 63 is arranged so that the axial direction of the second link pin 63 is parallel to the axial direction of the first link pin 62. The second link pin 63 is located in the basal portion of the lug arm 61 separated from where the lug arm 61 extends in the axial direction Z. The second link pin 63 is extended through the basal portion of the lug arm 61 and fixed to the rotation shaft 20. The basal portion of the lug arm 61 is pivotally supported by the rotation shaft 20 about the axis of the second link pin 63, which serves as the second pivot center M2.

The compressor 10 includes an actuator 70 that changes the inclination angle of the swash plate 50. The actuator 70 is located closer to the rear housing 13 than the swash plate 50.

The actuator 70 includes a movable body 71 that is movable in the axial direction Z, and a partition 72 that defines a control chamber A3 in cooperation with the movable body 71, and two coupling pieces 73 that couple the movable body 71 to the swash plate 50.

The movable body 71 has the form of a tube (more specifically, cylindrical tube) and includes a bottom and a tubular portion. The bottom of the movable body 71 includes insertion hole through which the rotation shaft 20 can be inserted. The movable body 71 rotates integrally with the rotation shaft 20 with the rotation shaft 20 inserted through the insertion hole and an open end of the movable body 71 directed toward the swash plate chamber A2.

The partition 72 has the form of a flat ring and has an outer diameter that is set to be the same as an inner diameter of the movable body 71. The partition 72, which is fitted onto the rotation shaft 20 and into the movable body 71, is fixed to the rotation shaft 20 so that the partition 72 rotates integrally with the rotation shaft 20. The partition 72 closes the open end of the movable body 71 that is close to the swash plate chamber A2. The control chamber A3 is defined by an inner circumferential surface and a bottom surface of the movable body 71 and a surface of the partition 72 located at the side opposite to the swash plate chamber A2. The control chamber A3 is used to control the inclination angle of the swash plate 50.

A portion between the inner circumferential surface of the movable body 71 and an outer circumferential surface of the partition 72 is sealed to restrict movement of refrigerant between the control chamber A3 and the swash plate chamber A2. This allows the control chamber A3 and the swash plate chamber A2 to have different pressures. The position of the movable body 71 changes in accordance with the pressure difference of the control chamber A3 and the swash plate chamber A2.

The rotation shaft 20 includes a shaft passage 74 that allows communication between the regulation chamber A1 and the control chamber A3. The shaft passage 74 includes an axial portion, which opens in the regulation chamber A1 and extends in the axial direction Z, and a radial portion, which is in communication with the axial portion. The radial portion opens in the control chamber A3 and extends in the radial direction R. The shaft passage 74 allows refrigerant to move between the control chamber A3 and the regulation chamber A1. Thus, the control chamber A3 and the regulation chamber A1 have the same pressure.

The compressor 10 includes a pressure controller 75 that controls the pressure of the regulation chamber A1. The pressure controller 75 includes a low-pressure passage that allows communication between the second suction chamber 43 and the regulation chamber A1, a high-pressure passage that allows communication between the second discharge chamber 44 and the regulation chamber A1, a valve that is located in the low-pressure passage and regulates the amount of refrigerant discharged from the regulation chamber A1 into the second suction chamber 43, and an orifice that is located in the high-pressure passage and regulates the flow rate of the discharged refrigerant flowing in the high-pressure passage. The pressure controller 75 controls the pressure of the control chamber A3 by controlling the valve. This allows the position of the movable body 71 to be adjusted.

The two coupling pieces 73 project toward the swash plate 50 from part of the annular open end of the movable body 71 as viewed in the axial direction Z. More specifically, the two coupling pieces 73 project toward the swash plate 50 from a portion of the movable body 71 located at the side opposite to the distal portion of the lug arm 61 with respect to the rotation shaft 20 as viewed in the axial direction Z. The two coupling pieces 73 are opposed to each other in a direction in which the pivot axes of the two pivot centers M1 and M2 extend (direction in which pivot centers M1 and M2 extend).

The swash plate 50 includes a plate-shaped coupling receiving portion 76 that projects out of the second inclined surface 52*b* and overlaps the two coupling pieces 73 as viewed in the pivot axis. The coupling receiving portion 76 and the arm through hole 52*c* are located in the second inclined surface 52*b* at opposite sides of the swash plate insertion hole 51. The coupling receiving portion 76 includes a coupling hole through which a coupling pin 77 extending in the pivot axis can be inserted. The coupling pin 77 is located between the two coupling pieces 73 and fixed to the two coupling pieces 73, inserted through the coupling hole of the swash plate 50. Thus, the swash plate 50 is supported by the movable body 71. In this case, the movement of the movable body 71 changes the inclination angle of the swash plate 50. That is, adjustment of the position of the movable body 71 adjusts the inclination angle of the swash plate 50.

To simplify the drawings, the coupling pin 77 and the coupling hole have the same shape. However, the coupling hole actually has an oval shape elongated in the vertical direction and has a larger diameter than the coupling pin 77 so as to correspond to changes in the inclination angle of the swash plate 50.

The swash plate 50 includes a first projection 81 that projects out of the first inclined surface 52*a* and a second projection 82 that projects out of the second inclined surface 52*b*. The second projection 82 is separate from the coupling receiving portion 76.

The first projection 81 does not extend over the entire circumference of the first inclined surface 52*a*. Rather, the first projection 81 extends over a portion of the first inclined surface 52*a* located at the opposite side of the arm through hole 52*c* with respect to the swash plate insertion hole 51. The second projection 82 extends in the circumferential direction around the swash plate insertion hole 51 on the second inclined surface 52*b*. The two projections 81 and 82 are located at the inner side of a portion of the inclined surfaces 52*a* and 52*b* that is held by two shoes 120 (described later). Thus, the swash plate 50 includes a circumferential portion that is thinner than the portion where the two projections 81 and 82 and the coupling receiving portion 76 are arranged.

A recovery spring 83 is fixed to the first shaft projection 20*a* of the rotation shaft 20. The recovery spring 83 extends in the axial direction Z from the first shaft projection 20*a* toward the swash plate chamber A2. Further, an inclination reduction spring 84 is arranged between the partition 72 and the swash plate 50. The inclination reduction spring 84 includes one end fixed to the partition 72 and the other end fixed to the swash plate 50. The inclination reduction spring 84 biases the swash plate 50 in a direction that decreases the inclination angle of the swash plate 50.

The compressor 10 includes pairs of cylinder bores 91 and 92. The cylinder bores 91 and 92 of each pair are opposed to each other in the axial direction Z and located at the outer side of the rotation shaft 20 in the radial direction R in the housing 11. The cylinder bores 91 and 92 are located at the outer side of the shaft holes 21 and 22 in the radial direction R. The pairs of the cylinder bores 91 and 92 are laid out in the circumferential direction around the shaft holes 21 and 22 of the cylinder blocks 14 and 15. The cylinder bores 91 are opposed to the cylinder bores 92 at opposite sides of the swash plate chamber A2.

To facilitate understanding, FIG. 1 shows only one of the cylinder bores 91 and one of the cylinder bores 92. Further, the cylinder bores 91 and 92 are separated from the suction passages 54*a* and 54*b* in the circumferential direction so that the cylinder bores 91 and 92 do not interfere with the suction passages 54*a* and 54*b* around the shaft holes 21 and 22.

The cylinder bores 91 and 92 extend through the corresponding cylinder blocks 14 and 15 in the axial direction Z. One opening of each of the cylinder bores 91 and 92 is in communication with the swash plate chamber A2, and the other opening of each of the cylinder bores 91 and 92 is closed by the valve/port body 23 or 24. The first valve/port body 23 partitions each first cylinder bore 91 from the first suction chamber 33 and the first discharge chamber 34, and the second valve/port body 24 partitions each second cylinder bore 92 from the second suction chamber 43 and the second discharge chamber 44.

The valve/port bodies 23 and 24 close the openings of the cylinder bores 91 and 92 and include suction ports 23*a* and 24*a* that are respectively in communication with the suction chambers 33 and 43, and discharge ports 23*b* and 24*b*, which are respectively in communication with the discharge chambers 34 and 44. The suction ports 23*a* and 24*a* and the discharge ports 23*b* and 24*b* are laid out in the circumferential direction in correspondence with the cylinder bores 91 and 92 that are laid out in the circumferential direction.

The compressor 10 includes a double-headed piston that reciprocates in each pair of the cylinder bores 91 and 92 and the corresponding pair of shoes 120 that couple the double-headed piston 100 to the swash plate 50.

The double-headed piston 100 is accommodated in each pair of the cylinder bores 91 and 92 so that the axial direction of the double-headed piston 100 corresponds to the axial direction Z of the rotation shaft 20 (i.e., opposing direction of two cylinder bores 91 and 92).

The double-headed pistons 100 are laid out in the circumferential direction in correspondence with the cylinder bores 91 and 92 laid out in the circumferential direction. That is, each pair of the cylinder bores 91 and 92 includes one of the double-headed pistons 100.

The structures of the double-headed piston 100 and the like will now be described in detail.

Figure 2:
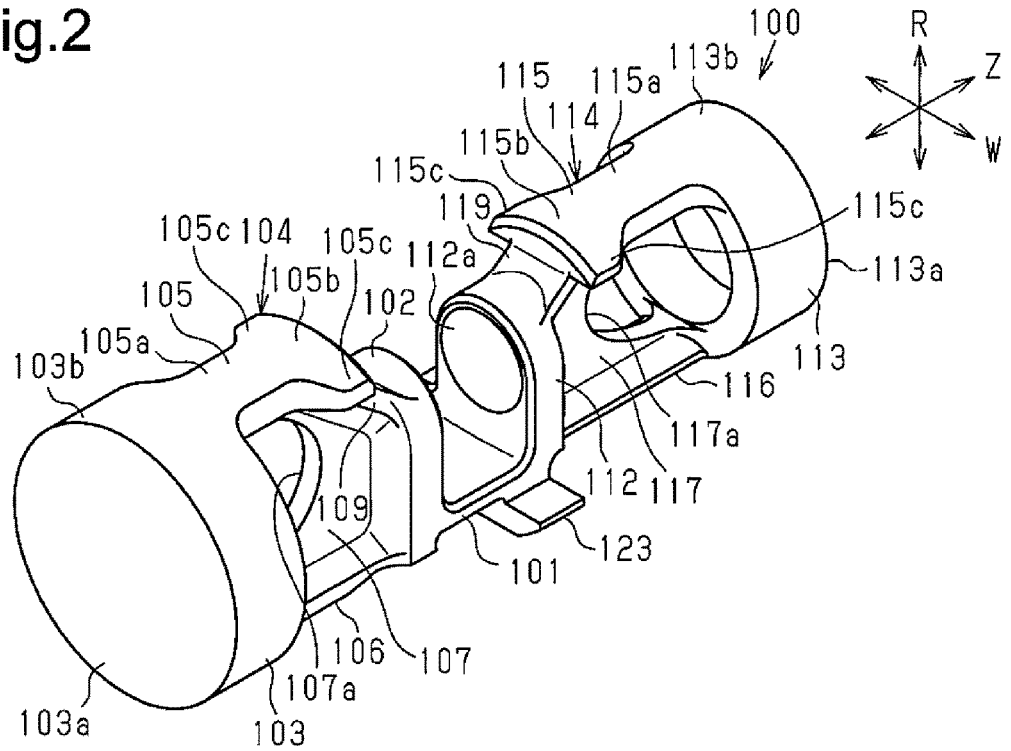
FIG. 2 is a perspective view of a double-headed piston shown in FIG. 1.
Figure 3:
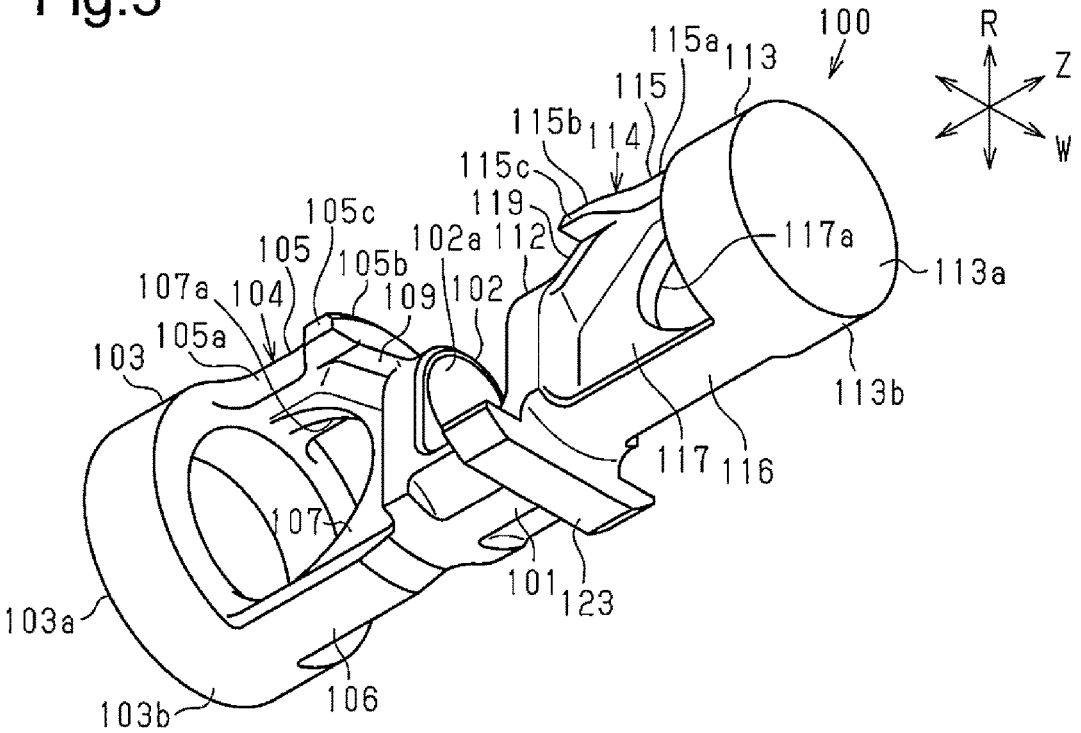
FIG. 3 is a perspective view of the double-headed piston shown in FIG. 1.
Figure 4:
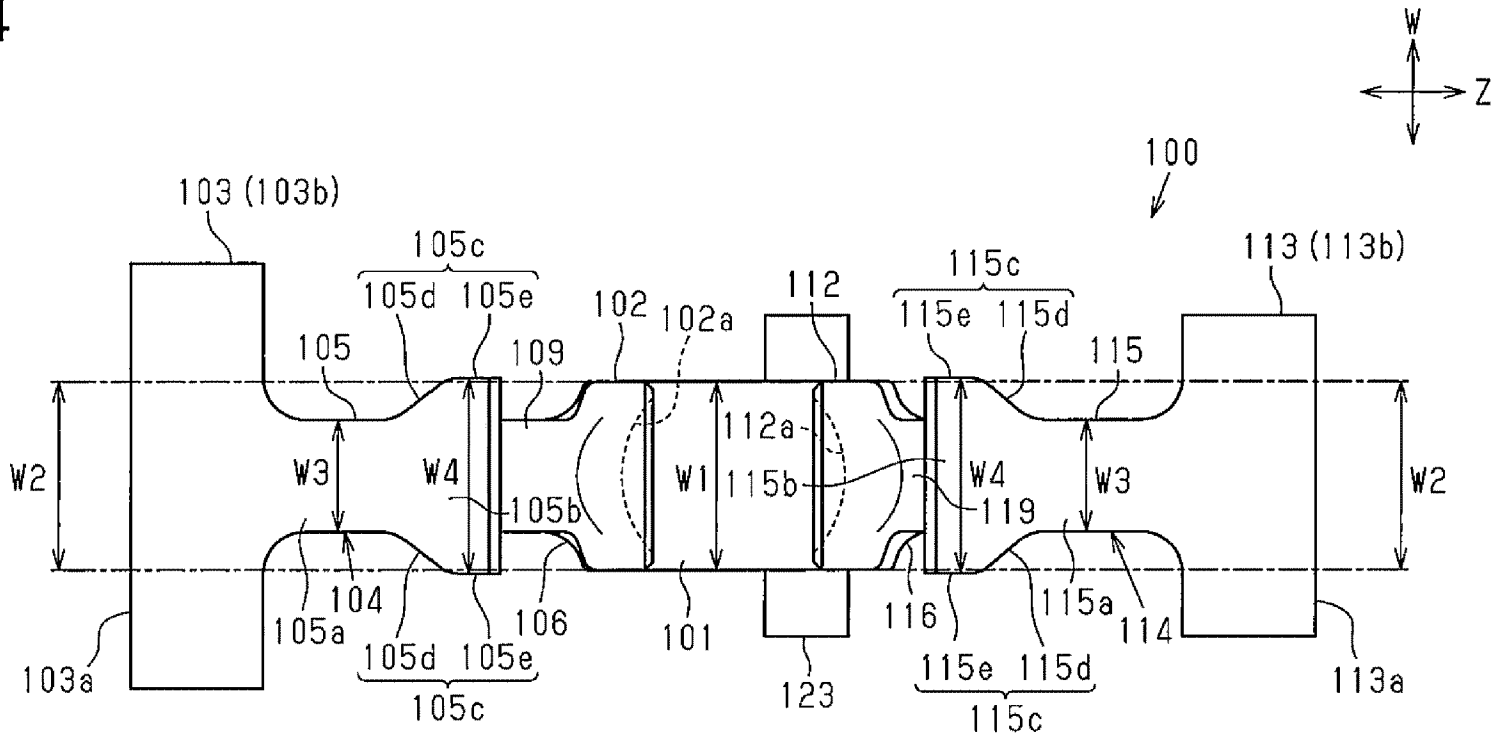
FIG. 4 is a plan view of the double-headed piston shown in FIG. 1 as viewed from a radially inner side.

As shown in FIGS. 2 to 4, the double-headed piston 100 includes a neck 101, shoe holders 102 and 112 that hold the shoes 120, two heads 103 and 113 located at the two ends of the double-headed piston 100 in the axial direction of the double-headed piston 100, and two coupling portions 104 and 114 that respectively couple the shoe holders 102 and 112 to the heads 103 and 113. The two shoe holders 102 and 112 are opposed to each other in the axial direction of the double-headed piston 100. The neck 101 couples the two shoe holders 102 and 112.

The coupling portions 104 and 114 include inner portions 105 and 115 and outer portions 106 and 116 extending in the axial direction of the double-headed piston 100. The inner portions 105 and 115 are respectively opposed to the outer portions 106 and 116 in the radial direction R. Further, the coupling portions 104 and 114 include plates 107 and 117 that couple the inner portions 105 and 115 to the outer portions 106 and 116, respectively. The inner portions 105 and 115 are located at the inner side of the outer portions 106 and 116 in the radial direction R (i.e., in portion of double-headed piston 100 that is closer to rotation shaft 20).

The axial direction of the double-headed piston 100 is the direction in which the head 103 is opposed to the head 113, and the radial direction R is the direction in which the inner portions 105 and 115 are opposed to the outer portions 106 and 116. To facilitate understanding, a direction orthogonal to both of the axial direction of the double-headed piston 100 and the opposing direction of the inner portions 105 and 115 and the outer portions 106 and 116 is hereinafter referred to as the widthwise direction W.

The two shoe holders 102 and 112 include semi-spherical surfaces 102*a* and 112*a*. The semi-spherical surfaces 102*a* and 112*a* are recessed away from each other.

Figure 5:
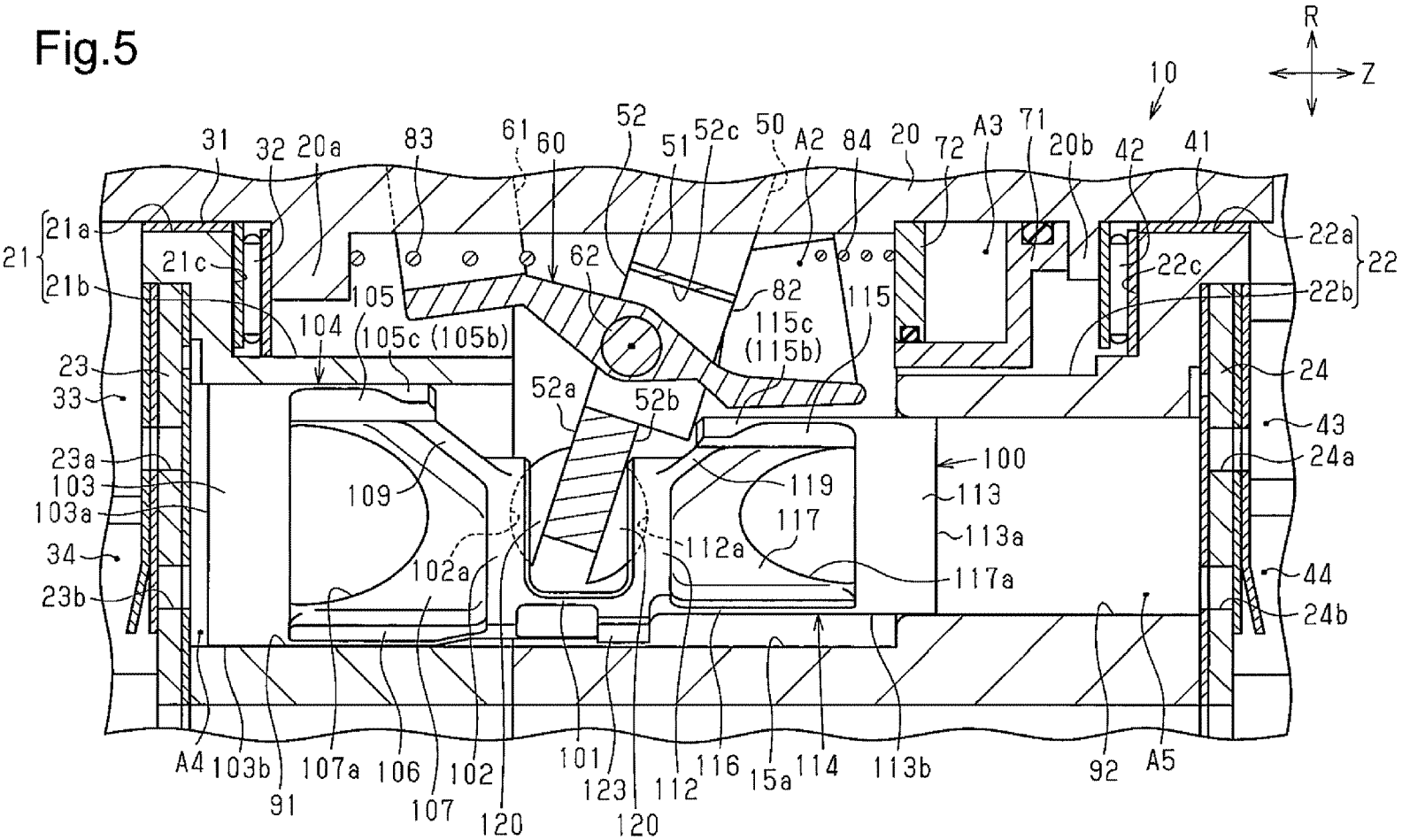
FIG. 5 is an enlarged view schematically showing the double-headed piston shown in FIG. 1 and the surrounding of the double-headed piston.
Figure 6:
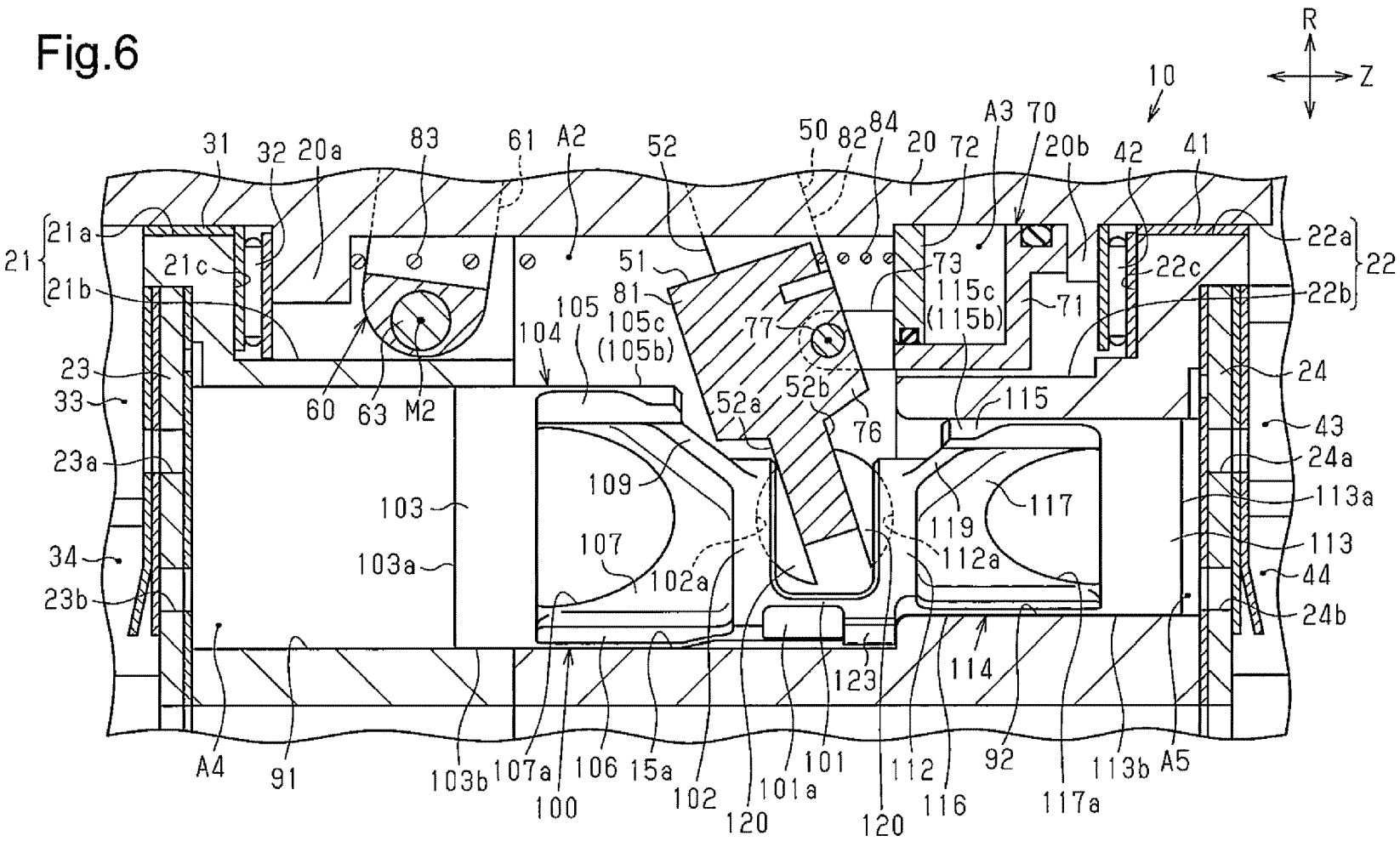
FIG. 6 is an enlarged view schematically showing the double-headed piston shown in FIG. 1 and the surrounding of the double-headed piston.

As shown in FIGS. 5 and 6, the circumferential portion of the swash plate 50 is arranged between the shoe holders 102 and 112. One of the two shoes 120 is located between the first inclined surface 52*a* of the swash plate 50 and the first semi-spherical surface 102*a* of the first shoe holder 102. The other one of the two shoes 120 is located between the second inclined surface 52*b* of the swash plate 50 and the second semi-spherical surface 112*a* of the second shoe holder 112. Each shoe 120 is semi-spherical. The shoes 120 include bottom surfaces that abut against the circumferential portions of the corresponding inclined surfaces 52*a* and 52*b* and spherical surfaces that abut against the corresponding semi-spherical surfaces 102*a* and 112*a*. The shoe holders 102 and 112 hold the two shoes 120, with the two shoes 120 holding the circumferential portion of the swash plate 50.

Rotation of the swash plate 50 applies pressing force, including a component of the axial direction Z, to the double-headed piston 100 through the shoes 120. This converts the rotation of the swash plate 50 into reciprocation of the double-headed piston 100. In this case, the stroke of the double-headed piston 100 changes in accordance with the inclination angle of the swash plate 50.

The neck 101 is located at an outer circumferential side of the swash plate 50, more specifically, at the outer side of the swash plate 50 in the radial direction R. As shown in FIG. 4, the width W1 of the neck 101 is the same as the width W2 of the shoe holders 102 and 112. However, the width W1 of the neck 101 may be larger than the width W2. The two shoe holders 102 and 112 are located at the two ends of the inner surface of the neck 101 in the axial direction of the double-headed piston 100.

As shown in FIG. 3, the outer surface of the neck 101 is curved in conformance with the wall surface of the first cylinder bore 91. As shown in FIGS. 2 and 3, the heads 103 and 113, each of which is tubular and has a bottom, include bottom surfaces 103*a* and 113*a* and outer circumferential surfaces 103*b* and 113*b* and are open toward the shoe holders 102 and 112, respectively. The first head 103 is at least partially accommodated in the first cylinder bore 91 regardless of where the double-headed piston 100 is located. The second head 113 is at least partially accommodated in the second cylinder bore 92 regardless of where the double-headed piston 100 is located.

As shown in FIGS. 5 and 6, the cylinder bores 91 and 92 respectively include compression chambers A4 and A5 that are defined by the bottom surfaces 103*a* and 113*a* of the heads 103 and 113, the wall surfaces of the cylinder bores 91 and 92, and the valve/port bodies 23 and 24. The compression chambers A4 and A5 are in communication with the suction chambers 33 and 43 with the suction ports 23*a* and 24*a* located in between and are in communication with the discharge chambers 34 and 44 with the discharge ports 23*b* and 24*b* located in between.

Reciprocation of the double-headed piston 100 draws refrigerant from the suction chambers 33 and 43 into the compression chambers A4 and A5, where the refrigerant is compressed. Then, the refrigerant is discharged into the discharge chambers 34 and 44. The stroke of the double-headed piston 100 changes in accordance with the inclination angle of the swash plate 50 and varies the displacement of the compressed refrigerant. That is, the compressor 10 of the present embodiment is of a variable displacement type.

In the present embodiment, the head 103 has a larger diameter than the second head 113. Thus, the first head 103 and the second head 113 have different areas that receive pressure from the refrigerant.

Further, the first cylinder bore 91 is larger than the second cylinder bore 92 in correspondence with the difference in diameter of the two heads 103 and 113. More specifically, the wall surface of the first cylinder bore 91 has a larger diameter than the wall surface of the second cylinder bore 92.

As shown in FIG. 3, the outer surface of the neck 101 includes a rotation stopper 123 that restricts rotation of the double-headed piston 100 in the two cylinder bores 91 and 92. As shown in FIG. 4, the rotation stopper 123 extends in the widthwise direction W. The two ends of the rotation stopper 123 in the widthwise direction W extend out of the neck 101 as viewed in the radial direction R. The rotation stopper 123 includes an outer surface curved in conformance with a side wall inner surface 15*a*. The outer surface of the rotation stopper 123 abuts against the side wall inner surface 15*a* to restrict rotation of the double-headed piston 100 about the axis of the piston.

The first inner portion 105 and the first outer portion 106 of the first coupling portion 104 each have an outer surface curved in conformance with the wall surface of the cylinder bore 91. The second inner portion 115 and the second outer portion 116 of the second coupling portion 114 each have an outer surface curved in conformance with the wall surface of the cylinder bore 92.

As shown in FIGS. 2 and 3, the first outer portion 106 extends in the axial direction of the double-headed piston 100 from the outer portion of the first head 103 in the radial direction R and couples the first head 103 to the first shoe holder 102 and the neck 101. More specifically, the first outer portion 106 is connected to the portion where the first shoe holder 102 is connected to the neck 101 and the outer portion of the first head 103 in the radial direction R. The first outer portion 106 is a plate having a width in the widthwise direction W and a thickness in the radial direction R.

The first inner portion 105 extends in the axial direction of the double-headed piston 100 from the inner portion of the first head 103 in the radial direction R. The first inner portion 105 includes a first narrow portion 105*a* located near the first head 103 and extended continuously from the first head 103 and a first wide portion 105*b* located near the first shoe holder 102. Thus, the first wide portion 105*b* and the first head 103 are located at opposite sides of the first narrow portion 105*a* in the axial direction of the double-headed piston 100.

The first inner portion 105 is a plate having a width in the widthwise direction W and a thickness in the radial direction R. The first inner portion 105 is shorter in the axial direction of the double-headed piston 100 than the first outer portion 106. Thus, the first wide portion 105*b* of the first inner portion 105 is located between the first head 103 and the first shoe holder 102 as viewed in the radial direction R.

As shown in FIG. 4, the width W3 of the first narrow portion 105*a* is smaller than the shoe width W2. The first wide portion 105*b* includes two first drawing portions 105*c* that are continuous with the first narrow portion 105*a* and project out of the first narrow portion 105*a* toward opposite sides in the widthwise direction W. Thus, the first wide portion 105*b* projects out of the first narrow portion 105*a* toward the opposite sides in the widthwise direction W. The first drawing portions 105*c* include enlarged portions 105*d* including two side surfaces that are continuous with the first narrow portion 105*a* and extend outward in the widthwise direction W to gradually widen the drawing portions 105*c* as the first head 103 becomes farther in the axial direction of the double-headed piston 100. Further, the first drawing portions 105*c* include maximum width portions 105*e* including two side surfaces that are continuous with the enlarged portions 105*d* and extend in the axial direction of the double-headed piston 100. The width W4 of the first wide portion 105*b* is larger than the width W3 of the first narrow portion 105*a*. The width W4 of the first wide portion 105*b* is the width of the maximum width portion 105*e* in the widthwise direction W.

As shown in FIG. 2, the outer surfaces of the first narrow portion 105*a* and the first wide portion 105*b* are located on the outer circumferential surface 103*b* of the first head 103 and curved in conformance with the wall surface of the cylinder bore 91. The outer surface of the first wide portion 105*b* is slidable on the wall surface of the corresponding first cylinder bore 91 when the double-headed piston 100 reciprocates in the corresponding pair of the cylinder bores 91 and 92.

The first inner portion 105 is located at the inner side of the first shoe holder 102 in the radial direction R. Thus, the wide portion 105*b* of the first inner portion 105 and the first shoe holder 102 form a step. The first coupling portion 104 includes a first rib 109 that connects the first shoe holder 102 and the wide portion 105*b* of the first inner portion 105, which form a step. The first rib 109 is inclined as viewed in the widthwise direction W.

The thickness-wise direction of the first plate 107 in the first coupling portion 104 is the widthwise direction W. That is, the first plate 107 has a thickness in the widthwise direction W. The thickness of the first plate 107 is smaller than the widths of the first inner portion 105 and the first outer portion 106. The first plate 107 includes a first through hole 107*a* extending in the widthwise direction W. The first through hole 107*a* is, for example, defined by a wall recessed toward the first shoe holder 102 as viewed in the widthwise direction W and is in communication with the interior of the first head 103, which is tubular and has a bottom.

The second coupling portion 114 is basically the same as the first coupling portion 104 except that, for example, the second coupling portion 114 is longer in the axial direction of the double-headed piston 100 than the first coupling portion 104.

As shown in FIGS. 2 and 3, the second outer portion 116 extends in the axial direction of the double-headed piston 100 from the outer portion of the second head 113 in the radial direction R and couples the second head 113 to the second shoe holder 112 and the neck 101.

The second inner portion 115 extends continuously in the axial direction of the double-headed piston 100 from the inner portion of the second head 113 in the radial direction R. The second inner portion 115 includes a second narrow portion 115*a* located near the second head 113 and a second wide portion 115*b* located near the second shoe holder 112. Thus, the second wide portion 115*b* and the second head 113 are located at opposite sides of the second narrow portion 115*a* in the axial direction of the double-headed piston 100.

As shown in FIG. 4, the width W3 of the second narrow portion 115*a* is smaller than the shoe width W2. The second wide portion 115*b* includes two second drawing portions 115*c* that are continuous with the second narrow portion 115*a* and project out of the second narrow portion 115*a* toward opposite sides in the widthwise direction W. Thus, the second wide portion 115*b* projects out of the second narrow portion 115*a* toward the opposite sides in the widthwise direction W. The second drawing portions 115*c* include enlarged portions 115*d* including two side surfaces that are continuous with the second narrow portion 115*a* and extend outward in the widthwise direction W to gradually widen the drawing portions 115*c* as the second head 113 becomes farther in the axial direction of the double-headed piston 100. Further, the second drawing portions 115*c* include maximum width portions 115*e* including two side surfaces that are continuous with the enlarged portions 115*d* and extended in the axial direction of the double-headed piston 100. The width W4 of the second wide portion 115*b* is larger than the width W3 of the second narrow portion 115*a*. The width W4 of the second wide portion 115*b* is the width of the maximum width portion 115*e* in the widthwise direction W. The first wide portion 105*b* and the second wide portion 115*b* may have widths W4 that are the same or different.

As shown in FIG. 2, the outer surfaces of the second narrow portion 115*a* and the second wide portion 115*b* are located on the outer circumferential surface 113*b* of the second head 113 and curved in conformance with the wall surface of the cylinder bore 92. The outer surface of the second wide portion 115*b* is slidable on the wall surface of the corresponding second cylinder bore 92 when the double-headed piston 100 reciprocates in the corresponding pair of the cylinder bores 91 and 92.

The second inner portion 115 is located at the inner side of the second shoe holder 112 in the radial direction R. Thus, the wide portion 115*b* of the first inner portion 115 and the second shoe holder 112 form a step. The second inner portion 115 includes a second rib 119 that connects the second shoe holder 112 and the wide portion 115*b* of the second inner portion 115, which form a step. The second rib 119 is inclined as viewed in the widthwise direction W.

The thickness of the second plate 117 of the second coupling portion 114 is smaller than the widths of the second inner portion 115 and the second outer portion 116. The second plate 117 includes a second through hole 117*a* extending in the widthwise direction W. The second through hole 117*a* is, for example, defined by a wall recessed toward the second shoe holder 112 as viewed in the widthwise direction W and is in communication with the interior of the second head 113, which is tubular and has a bottom.

The operation of the present embodiment will now be described.

When the double-headed piston 100 reciprocates in the corresponding pair of the cylinder bores 91 and 92, the first head 103 slides on the wall surface of the cylinder bore 91, and the second head 113 slides on the wall surface of the cylinder bore 92.

As shown in FIG. 5, when the double-headed piston 100 moves in the corresponding pair of the cylinder bores 91 and 92 so that the first head 103 moves from the bottom dead center toward the top dead center as the outer surface of the first wide portion 105*b* slides on the wall surface of the cylinder bore 91, lubricant in the cylinder bore 91 is drawn toward the first head 103 by the first drawing portions 105*c* of the first wide portion 105*b*. Thus, lubricant is efficiently supplied between the first head 103 and the wall surface of the cylinder bore 91.

As shown in FIG. 6, when the double-headed piston 100 moves in the corresponding pair of the cylinder bores 91 and 92 so that the second head 113 moves from the bottom dead center toward the top dead center as the outer surface of the second wide portion 115*b* slides on the wall surface of the cylinder bore 92, lubricant in the cylinder bore 92 is drawn toward the second head 113 by the second drawing portions 115*c* of the second wide portion 115*b*. Thus, lubricant is efficiently supplied between the second head 113 and the wall surface of the cylinder bore 92.

The above embodiment has the advantages described below.

(1) The inner portions 105 and 115 include the wide portions 105*b* and 115*b* that are located at opposite sides of the heads 103 and 113 with respect to the narrow portions 105*a* and 115*a* in the axial direction of the double-headed piston 100. The wide portions 105*b* and 115*b* project out of the narrow portions 105*a* and 115*a* in the widthwise direction W and have a larger width than the narrow portions 105*a* and 115*a*. The outer surfaces of the wide portions 105*b* and 115*b* are slidable on the wall surfaces of the corresponding cylinder bores 91 and 92 when the double-headed piston 100 reciprocates in the cylinder bores 91 and 92. In this structure, when the double-headed piston 100 moves from the bottom dead center toward the top dead center as the outer surfaces of the wide portions 105*b* and 115*b* slide on the wall surfaces of the cylinder bores 91 and 92, lubricant in the cylinder bores 91 and 92 is drawn toward the heads 103 and 113 by the wide portions 105*b* and 115*b*. Thus, lubricant is easily supplied between the heads 103 and 113 and the wall surfaces of the corresponding cylinder bores 91 and 92. This improves lubrication between the heads 103 and 113 and the wall surfaces of the corresponding cylinder bores 91 and 92.

(2) The wide portions 105*b* and 115*b* project toward the opposite sides in the widthwise direction W. This increases the amount of lubricant in the cylinder bores 91 and 92 drawn toward the heads 103 and 113 by the wide portions 105*b* and 115*b* as the double-headed piston 100 moves from the bottom dead center toward the top dead center and the outer surfaces of the wide portions 105*b* and 115*b* slide on the wall surfaces of the cylinder bores 91 and 92 compared to, for example, when the wide portions 105*b* and 115*b* project toward only one side in the widthwise direction W. As a result, lubricant is more easily supplied between the heads 103 and 113 and the wall surfaces of the cylinder bores 91 and 92. This further improves lubrication between the heads 103 and 113 and the wall surfaces of the cylinder bores 91 and 92.

(3) The compressor 10 includes the actuator 70 that changes the inclination angle of the swash plate 50. The actuator 70 includes the movable body 71, which is movable in the axial direction Z of the rotation shaft 20, and the partition 72, which defines the control chamber A3 in cooperation with the movable body 71. The actuator 70 changes the inclination angle of the swash plate 50 when the movable body 71 moves in accordance with the pressure of the control chamber A3. Since the lubrication between the heads 103 and 113 and the wall surfaces of the cylinder bores 91 and 92 is improved, the efficiency for sliding the double-leaded piston 100 is improved. This increases the controllability of variable displacement.

(4) The second head 113 has a smaller diameter than the first head 103. Thus, the first head 103 and the second head 113 respectively include refrigerant pressure receiving areas that differ from each other. Accordingly, the first head 103 and the second head 113 have different compression reaction forces that result from the compression of refrigerant. This allows variable displacement to be easily performed. Thus, the controllability of variable displacement is increased.

It should be apparent to those skilled in the art that the present invention may be embodied in many other specific forms without departing from the spirit or scope of the invention. Particularly, it should be understood that the present invention may be embodied in the following forms.

Figure 7:
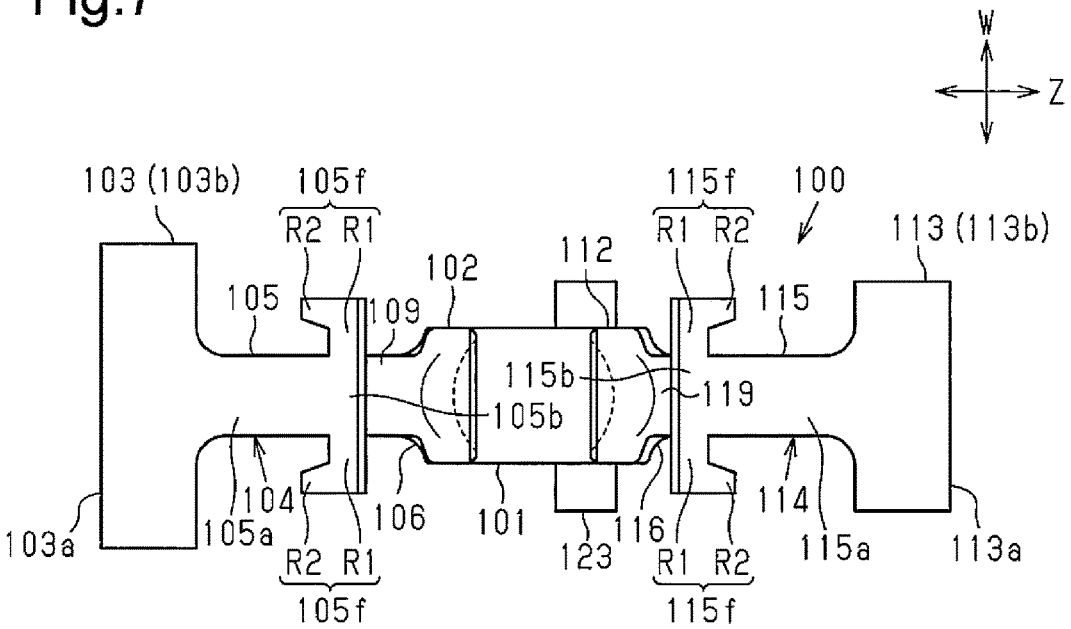
FIG. 7 is a plan view showing a double-headed piston of another example.

As shown in FIG. 7, two drawing portions 105*f* and 115*f* may each have an extension R1 and a projection R2 as viewed in the radial direction R. The extension R1 extends in the widthwise direction W, and the projection R2 is continuous with a distal portion of the extension R1 and projected toward the head 103 or 113. Each projection R2 includes a side surface that is closer to the narrow portion 105*a* or 115*a*. The side surface extends further away in the widthwise direction W from the narrow portion 105*a* or 115*a* as the head 103 or 113 becomes closer.

Figure 8:
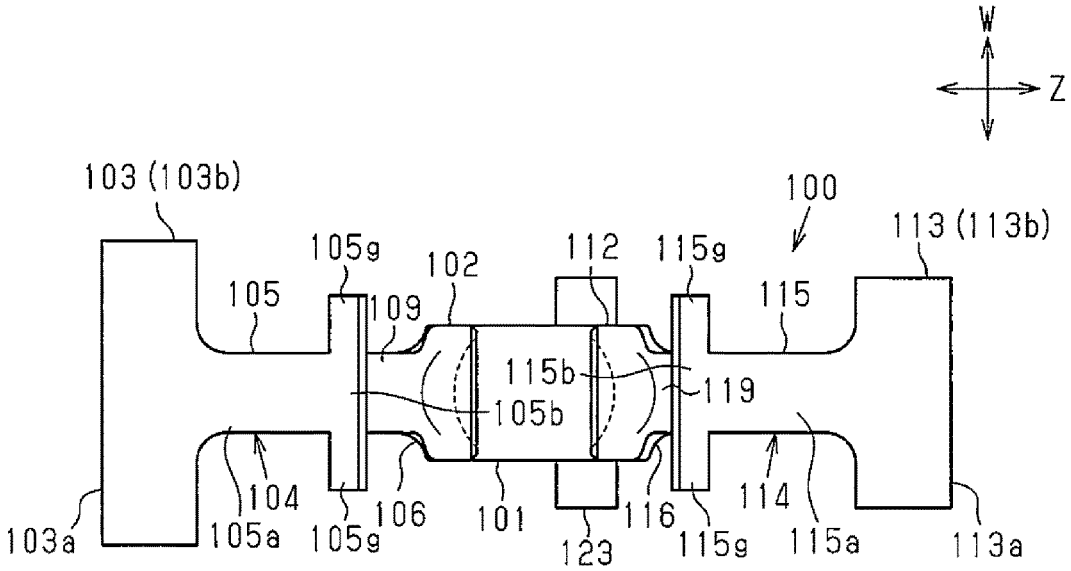
FIG. 8 is a plan view showing a double-headed piston of a further example.

As shown in FIG. 8, the enlarged portions 105*d* and 115*d* may be omitted. That is, the wide portions 105*b* and 115*b* may each have two drawing portions 105*g* and 115*g* that extend in the widthwise direction W as viewed in the radial direction R.

In the embodiment, the outer surfaces of the narrow portions 105*a* and 115*a* and the wide portions 105*b* and 115*b* may be located at the inner sides of the outer circumferential surfaces 103*b* and 113*b* of the heads 103 and 113 in the radial direction R so that steps are formed between the heads 103 and 113 and the narrow portions 105*a* and 115*a*. Rotation of the swash plate 50 applies pressing force, including a component of the radial direction R and a component of the widthwise direction W, to the double-headed piston 100 through the shoes 120. The pressing force deforms the double-headed piston 100 in at least one of the radial direction R and the widthwise direction W. If the neck 101 is deformed in the radial direction R and the double-headed piston 100 is deformed in the radial direction R, the wide portions 105*b* and 115*b* of the inner portions 105 and 115 abut against the wall surfaces of the cylinder bores 91 and 92 and limit further deformation of the neck 101. Further, the double-headed piston 100 moves from the bottom dead center toward the top dead center as the outer surfaces of the wide portions 105*b* and 115*b* slide on the wall surfaces of the cylinder bores 91 and 92. Thus, even when steps are formed between the heads 103 and 113 and the narrow portions 105*a* and 115*a* and when the outer surfaces of the narrow portions 105*a* and 115*a* and the wide portions 105*b* and 115*b* are located at the inner sides of the outer circumferential surfaces 103*b* and 113*b* of the heads 103 and 113 in the radial direction R, the outer surfaces of the wide portions 105*b* and 115*b* are slidable on the inner surfaces of the cylinder bores 91 and 92.

In the embodiment, the wide portions 105*b* and 115*b* may project toward only one side in the widthwise direction W.

In the embodiment, the width W3 of the wide portions 105*b* and 115*b* may be the same as the shoe width W2.

In the embodiment, the first coupling portion 104 is shorter in the axial direction of the double-headed piston 100 than the second coupling portion 114. Instead, the first coupling portion 104 and the second coupling portion 114 may have the same length. Alternatively, the first coupling portion 104 may be longer than the second coupling portion 114.

In the embodiment, the first head 103 may have the same size as the second head 113 or may be larger than the second head 113. In addition, the heads 103 and 113 may be cylindrical.

In the embodiment, the neck 101 and the coupling portions 104 and 114 are not limited to the forms illustrated in the embodiment.

In the embodiment, the actuator 70 may have any specific structure as long as the actuator 70 is capable of changing the inclination angle of the swash plate 50. In the same manner, the link mechanism 60 may have any specific structure as long as the link mechanism 60 is capable of transmitting power from the rotation shaft 20 to the swash plate 50.

In the embodiment, at least one of the first projection 81 and the second projection 82 may be omitted.

The number of cylinder bores 91 and 92 and the number of double-headed pistons 100 are not limited to those of the embodiment and may each be, for example, one.

In the embodiment, the two inner portions 105 and 115 basically have the same width. Instead, the two inner portions 105 and 115 may have different widths. In the same manner, the two outer portions 106 and 116 basically have the same width. Instead, the two outer portions 106 and 116 may have different widths. Further, the first inner portion 105 and the first outer portion 106 may have the same width or different widths. The same applies to the widths of the second inner portion 115 and the second outer portion 116.

In the embodiment, the compressor 10 is of a variable displacement type. Instead, the compressor 10 may be of a fixed displacement type in which the inclination angle of the swash plate 50 is fixed.

In the embodiment, the compressor 10 is installed in a vehicle. However, the compressor 10 does not have to be installed in a vehicle.

Therefore, the present examples and embodiments are to be considered as illustrative and not restrictive and the invention is not to be limited to the details given herein, but may be modified within the scope and equivalence of the appended claims.

The invention claimed is:

1. A double-headed piston type swash plate compressor comprising:

a rotation shaft extending in an axial direction and a radial direction;

a housing that accommodates the rotation shaft;

a swash plate that rotates when the rotation shaft rotates;

two cylinder bores opposed to each other in the axial direction of the rotation shaft and located in the housing at an outer side of the rotation shaft in the radial direction;

a double-headed piston that reciprocates in the two cylinder bores; and two shoes that couple the double-headed piston to the swash plate, wherein the two cylinder bores and the double-headed piston define two compression chambers, rotation of the swash plate reciprocates the double-headed piston in the two cylinder bores and compresses refrigerant in each of the compression chambers, the double-headed piston includes:

two shoe holders that hold the two shoes, wherein the two shoe holders are opposed to each other in an axial direction of the double-headed piston;

a neck that couples the two shoe holders, wherein the neck is located at an outer circumferential side of the swash plate;

two heads located at two ends of the double-headed piston in the axial direction of the double-headed piston, wherein the two heads are respectively located in the two cylinder bores; and two coupling portions that couple the two shoe holders and the two heads, respectively, each of the coupling portions includes:

an outer portion extending in the axial direction of the double-headed piston; and an inner portion located at an inner side of the outer portion in the radial direction, wherein the inner portion is extended in the axial direction of the double-headed piston and opposed to the outer portion in the radial direction, when referring to a direction orthogonal to both of an opposing direction of the inner portion and the outer portion and the axial direction of the double-headed piston as a widthwise direction, the inner portion includes a narrow portion extending continuously from the corresponding head and a wide portion located at a side opposite to the head with respect to the narrow portion in the axial direction of the double-headed piston, the wide portion projects out of the narrow portion in the widthwise direction and has a larger width than the narrow portion, and an outer surface of the wide portion is slidable on a wall surface of the corresponding cylinder bore when the double-headed piston reciprocates in the cylinder bores.

2. The double-headed piston type swash plate compressor according to claim 1, wherein the wide portion projects toward opposite sides in the widthwise direction.

3. The double-headed piston type swash plate compressor according to claim 1, further comprising an actuator that changes an inclination angle of the swash plate, wherein the actuator includes:

a movable body that is movable in the axial direction of the rotation shaft; and a partition that defines a control chamber in cooperation with the movable body, and the actuator is operable to change an inclination angle of the swash plate when the movable body is moved in accordance with pressure of the control chamber.

4. The double-headed piston type swash plate compressor according to claim 3, wherein the two heads include a first head and a second head, and the second head has a smaller diameter than the first head.

* * * * *